United States Patent [19]

Raasch et al.

[11] Patent Number: 4,724,665

[45] Date of Patent: Feb. 16, 1988

[54] METHOD OF PIECING YARN IN THE OPERATION OF AN OPEN END ROTOR SPINNING MACHINE

[75] Inventors: Hans Raasch, Monchen-Gladbach, Fed. Rep. of Germany; Heinzbert Reiners, Waxhaw, N.C.

[73] Assignee: W. Schlafhorst & Co., Monchen-Gladbach, Fed. Rep. of Germany

[21] Appl. No.: 935,845

[22] Filed: Nov. 28, 1986

[30] Foreign Application Priority Data

Nov. 30, 1985 [DE] Fed. Rep. of Germany ..... 35423668

[51] Int. Cl.[4] ..... D01H 15/02; D01H 13/16

[52] U.S. Cl. ..... 57/263; 57/81; 57/261; 57/305; 57/264; 242/35.6 E

[58] Field of Search ..... 57/81, 301–305, 57/263, 261, 264, 405; 242/35.6 E

[56] References Cited

U.S. PATENT DOCUMENTS

| | | | |
|---|---|---|---|
| 3,586,251 | 6/1971 | Burdge | 242/43 |
| 4,137,699 | 2/1979 | Stahlecker et al. | 57/264 |
| 4,222,224 | 9/1980 | Raasch | 57/263 |
| 4,327,546 | 5/1982 | Derichs et al. | 57/263 |

FOREIGN PATENT DOCUMENTS

| | | |
|---|---|---|
| 1215466 | 4/1966 | Fed. Rep. of Germany . |
| 2025149 | 11/1970 | Fed. Rep. of Germany . |
| 1535091 | 10/1973 | Fed. Rep. of Germany . |
| 2622243 | 12/1977 | Fed. Rep. of Germany . |
| 3505188 | 8/1986 | Fed. Rep. of Germany . |

*Primary Examiner*—John Petrakes

*Attorney, Agent, or Firm*—Shefte, Pinckney & Sawyer

[57] ABSTRACT

A method of piecing yarn in the operation of an open end rotor spinning machine that includes applying the suction that picks up the yarn end from the bobbin package for an extended predetermined length of time longer than the optimal minimum length for a normal piecing operation, with the extended suction being of a time sufficient to remove an estimated extended length of defective yarn, either determined by sensing the absence of sliver or after two or three sequential unsuccessful piecing attempts.

5 Claims, 1 Drawing Figure

METHOD OF PIECING YARN IN THE OPERATION OF AN OPEN END ROTOR SPINNING MACHINE

BACKGROUND OF THE INVENTION

The present invention relates to a method of piecing yarn in the operation of an open end rotor spinning machine and more particularly to such a method in which an extended length of yarn that is likely to be defective is removed from the yarn package upon detecting a condition indicative of possible defective yarn.

In conventional open end rotor spinning machines the spun yarn is wound on a package and the yarn is continuously monitored as to defects, e.g. a yarn break or yarn thicknesses greater than or less than a predetermined quality range. In the event such a defect is detected, the operation at that spinning station is interrupted until an automatic piecing unit that travels along the spinning stations arrives at that station and performs a piecing operation.

The yarn preceding the interruption is wound onto the winding bobbin or package and the silver feed is stopped with the end of the sliver at the entrance to the spinning station. In preparation for the piecing operation, the rotor and associated elements are cleaned of fiber and yarn remnants either by the piecer or by an automatic cleaning device. The piecing operation then begins with a suction device applied to the package and the package rotated in a reverse direction, with the suction being applied for a sufficient time to assure pick-up of the yarn end, which is drawn off the package and held in the suction device, which guides the yarn for manipulation by the piecer to sever a portion of the end of the yarn, prepare the severed end for piecing, reverse feed of the prepared yarn end into the rotor to pick-up fibers being fed from the sliver, and thereupon restart the spinning operation.

The time of application of suction to the package is of a predetermined length sufficient to normally locate the yarn end on the package and unwind a sufficient length for satisfactory piecing, but limited to an optimal minimum time for normal successful operation without unduly extending the cycle time of the operation so that the piecing cycle time will be as short as possible for efficient overall production by the spinning machine.

Conventionally, a yarn sensor will detect when a piecing operation has been unsuccessful and the operation will then be repeated in an attempt to effect a satisfactory piecing, and if a sequence of unsuccessful attempts has occurred the piecer will provide a malfunction signal at that station to alert the operator, who will manually attempt to correct whatever problem has caused the malfunction.

One of the causes for malfunctioning is when the sliver feed is interrupted for some reason, such as the end of the sliver supply or a break in the sliver reaching the sliver feed. Often, the end of the sliver is of reduced thickness or tapered so that the amount of fiber being combed out of the sliver gradually reduces and results in the yarn becoming thinner over an extended length.

Another cause of malfunctioning occurs when the sliver has a loop or knot formed in it that cannot pass through the sliver feed, causing interruption of the spinning even though sliver is present at the feed.

In the prior art, the normal yarn monitoring is accepted as being sufficient to detect unacceptable yarn size variations in time to interrupt spinning without substantial defective yarn being wound on the package. However, this has been found to be less than satisfactorily reliable under conditions where extended sliver feed variations occur, such as when the sliver is running out or a sliver knot or loop is present.

Conventional piecing operations of the type described for use in open end rotor spinning machines are disclosed in Derichs and Raasch U.S. Pat. No. 4,327,546 and in West German Pat. No. PS 27 25 105.

The present invention provides a method for substantially removing defective yarn that may have been wound on a package immediately prior to the interruption of spinning, and thereby enhancing production and the quality of the resulting yarn.

SUMMARY OF THE INVENTION

The present invention provides a method for piecing yarn in the operation of an open end rotor spinning machine after an interruption in spinning wherein suction is applied to the package on which yarn has been wound to locate the yarn end thereon and to withdraw a sufficient length of yarn for severing a portion of yarn end, the severed end is prepared for piecing, and the prepared end is fed into the rotor to pick up fibers and restart spinning. The present method comprises applying the suction during a normal piecing operation for a predetermined length of time sufficient to locate the yarn end of the package and provide the yarn end for satisfactory piecing while limiting the predetermined time to an optimal minimum for efficient operation. The method includes detecting for an indication of an abnormal spinning interruption condition that may have resulted in an extended length of defective yarn having been wound on the package, and in response to detecting of an indication of an abnormal spinning interruption condition suction is applied to the package for a predetermined length of time longer than the optimal minimum length sufficient to remove an estimated extended length of defective yarn. In one form of the invention the absence of sliver being fed to the rotor is detected. In another form the detecting detects the occurrence of a sequence of unsuccessful piecing operation attempts, such as three unsuccessful attempts.

DESCRIPTION OF THE PREFERRED EMBODIMENT

Figure 1:
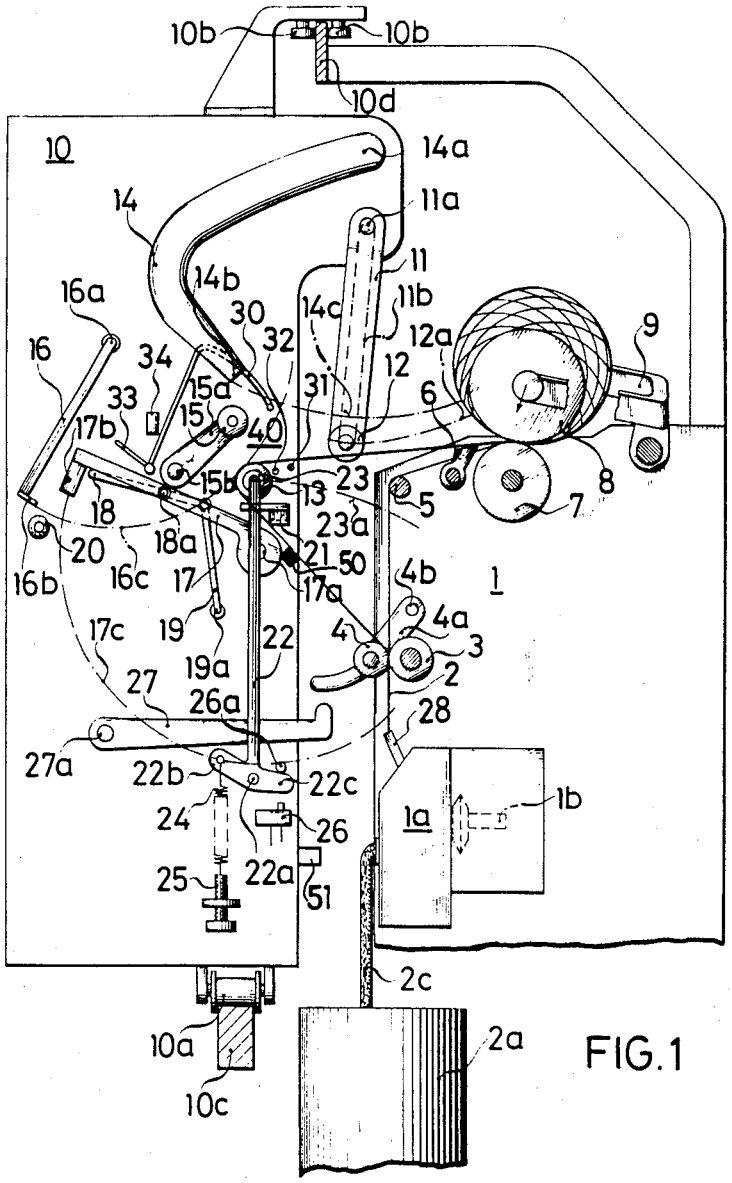
FIG. 1 is a side elevation of a spinning station and piecer of an automatic open end rotor spinning machine with which the preferred embodiment of the present invention is practiced.

In the preferred embodiment, the method of the present invention is practiced in conjunction with a known open end rotor spinning machine using a piecer that includes a suction tube that is moved into contact with the yarn package to pick up the end of yarn on the package after a spinning interruption, with the suction being applied for a time normally sufficient for a secure pick-up of the yarn while the package is being reversely rotated to unwind the yarn into the suction tube. The suction tube then moves to withdraw the yarn end for manipulation by the piecer into gripping rolls beyond which the yarn end is cut as by use of a grinder, with the cut off end being sucked away and the remaining severed end being somewhat opened in an optimum condition for picking up fibers when it is reversely fed into the rotor by the piecer as sliver is combed to feed fibers into the rotor. The piecer then causes the yarn to withdraw from the rotor and reestablish a spinning condition, and a sensor detects whether the piecing has been successful and, if so, the yarn is released from the piecer so that the piecer can resume travel along the spinning stations for operation at any other station at which a spinning interruption has occurred.

The operation of piecers of this type is set to cycle as quickly as possible within the expectation of effecting a proper piecing so that the spinning machine can operate at highest production efficiency without wasted downtime. For this reason, the length of time that suction is applied to pick up the end from the package is limited as much as possible to an optimal minimum and in normal operation the suction is sufficient to withdraw any defective portion of the yarn that has been wound on the package prior to the breaking operation, with this defective portion being severed and removed as explained above.

In the normal operation of the piecer, if the piecing operation has not been successful, the sensor signals the piecer to repeat the operation. This sequence may be repeated until a piecing occurs or until a sequence of unsuccessful attempts has been performed, such as two or three attempts, after which the piecer causes the station to provide an indication of malfunction and the piecer moves on to seek another spinning station at which spinning interruption has occurred. Upon noting the malfunction signal, the operator then manually attempts to repair the defective condition.

In the operation of conventional piecers it sometimes occurs that an extended length of defective yarn is wound on the package before a spinning interruption occurs, and this length may be considerably more than the length removed by the conventional suction and severing operation such that a defective portion of yarn remains in the finished product. This can occur when the feed of the sliver supply is interrupted by the sliver end reaching the combing device with a thinning or tapering of the sliver feed resulting in an extended reduction of the rate of fiber being combed into the rotor and a resulting extended reduction in the thickness of the spun yarn being wound on the package. This can also occur when there is a loop or knot in the sliver that resists feed through the combing device with an initial reduction in fiber feed and resulting thinning of the spun yarn, and ultimately an interruption in spinning.

By the preferred embodiment of the present invention, the absence of sliver at the sliver feed is detected so that when a spinning interruption occurs in combination with the absence of sliver feed, there is an indication of a possible extended length of defective yarn having been wound on the package. The application of suction is then responsive to apply suction for a predetermined length of time longer than the optimal minimum length of time, thereby removing and severing an estimated extended length of defective yarn from the package, rendering a yarn end that is prepared for proper piecing when the silver feed malfunction has been corrected.

When the malfunction is corrected and the piecer performs a subsequent piecing operation, there is a further length of yarn removed from the package by the normal suction operation that further increases the amount of yarn removed from the package, which can be taken into account in determining the amount of yarn that should be removed during the extended suction period of time.

Preferably, when the absence of sliver is detected, which means that no piecing can be accomplished, the piecer can be made to expedite cycling after the extended suction operation without dwells that are included when a piecing is being attempted.

Interruption of the feeding of sliver with a resulting spinning of an extended length of defective yarn and ultimate interruption of spinning may also occur when a loop or knot of sliver is at the sliver feed, in which case there would be an indication by a sliver sensor of the absence of sliver at the feed. However, if a sequence of piecing attempts is unsuccessful, it would be an indication that this problem exists and, in any event, would be an indication that some malfunction exists that requires attention by the operator. Therefore, in one form of the present invention the detecting determines whether there has been a sequence of unsuccessful piecing attempts and, if so, for example after two unsuccessful attempts, the suction for an extended length of time is incorporated in a final piecing operation to be sure that substantially all defective yarn that may have been wound on the package is removed and that a successful piecing will occur if at all possible or at least an extended length of yarn will have been removed to increase the opportunity for successful piecing when next attempted after correction of a malfunction.

In a typical method according to the present invention, the optimal minimum predetermined length of time during which suction is applied may be 6.2 seconds with a resulting yarn pick up of as much as 6 meters, and the predetermined extended length of time of applying the suction may be an additional 3, 6 or 9 seconds with a resulting total yarn pick up of as much as 14 meters.

The preferred embodiment of the present invention may be practiced using a yarn piecer 10 of the type disclosed in U.S. Pat. No. 4,327,546, FIG. 1 of which is repeated as FIG. 1 herein with the addition of a schematic illustration of an automatic piecing sensor 50, a sliver sensor 51 and a yarn path at the conclusion of piecing prior to release of the yarn by the piecer. The substance of the aforesaid patent is incorporated herein by reference with the reference numerals referred to herein being the same as those in the aforesaid patent. The reference numerals appearing in FIG. 1 that are not mentioned herein correspond to the reference numerals in that patent.

The piecer 10 is illustrated at a spinning station 1 of an open end rotor spinning machine. During normal spinning operation a sliver **2*c* feeds from a can 2*a* into a spin box 1*a* in which a rotor 1*b* receives fibers combed from the sliver 2*c* to form the yarn 2 that is drawn off through tube 28 by a driven take-up roll 3 and associated clamping roll 4. The yarn travels vertically upwardly around a guide roll 5 to a package 8 that is driven by a winding drum 7**.

When an interruption in spinning is detected by a conventional sensor (not shown) a signal is established at the spinning station that causes the piecer to stop as it travels along the machine to perform an automatic piecing operation. For this purpose a drive roll 12 is swung into position against the package 8 to lift the package 8 and cause it to rotate reversely. At the same time a suction arm 14 swings adjacent the package 8 to pick up the end of the yarn on the package. The suction arm 14 remains in this position a sufficient length of time to assure picking up of the end of yarn and to unwind a predetermined optimal length of yarn that may be defective. The suction arm 14 then swings back away from the package 8 and the grippers 16b on a yarn puller 16 engage the yarn and pull it down over a pull-off roll 13 for engagement by clamps 17b that advance the yarn to a grinding assembly 20 that severs the yarn and prepares the clamped end for piecing. The severed portion of the yarn is sucked away by the suction arm 14. The clamp 17b then swings down to position the end of the yarn at the yarn tube 28 of the spin box 1a and between the take-up roll 3 and clamping roll 4, which has been temporarily lifted by the lever 27 to allow positioning of the yarn between the take-up roll 3 and clamping roll 4. The take-up roll 3 is then reversely rotated to feed the end of the yarn into the tube 28 and rotor to piece the end of the yarn with the fibers in the rotor. The take-up roll 3 is then rotated forwardly to draw the yarn from the rotor for resumed spinning and take-up around the take-off roll 13 to the package 8.

In practicing the present invention an automatic piecing sensor 50 is mounted on the piecer 10 in the path of the yarn tube between the take-up roll 3 and the take-off roll 13. This sensor 50 determines whether the yarn has been successfully pieced. If not, it causes the piecing operation to be repeated. If three piecing operations in succession are unsuccessful, further piecing operations are discontinued and a signal is provided at the spinning station 1 to indicate to the operator that there is a malfunction that requires attention, and the piecer 10 resumes travel along the machine without having effected a successful piecing. If the sensor 50 determines that a successful piecing has occurred, the yarn is released from the take-off roll 13 and allowed to return to its path over the guide roll 5, freeing the piecer 10 to resume travel along the machine.

In practicing the preferred embodiment of the present invention, the piecer 10 is equipped with a sliver sensor 51 that monitors the sliver 2c as it enters the spin box 1a and emits a signal when there is an absence of sliver as when the sliver supply runs out or is otherwise interrupted. In response to the signal from the sliver sensor 51 the piecer performs only one piecing operation, following which a malfunction signal is established at the spinning station 1 and the piecer resumes traveling along the machine.

When either two unsuccessful attempts at piecing have been performed or when the absence of sliver is detected, there is a likelihood that an extended length of defective yarn has been spun and wound on the package.

In the present invention, when either two unsuccessful attempts at piecing have been performed or when the absence of sliver is detected, the suction arm 14 is positioned at the package 8 for an extended period of time longer than the optimal minimal length of time so as to remove an estimated extended length of defective yarn at the beginning of the third piecing attempt after two unsuccessful attempts or during the only piecing attempt after the absence of sliver is detected. The actual extended length, if any, of defective yarn that may have been wound on the package is not determined. Only an estimate is made of what length of yarn may be defective and the piecer is set to operate the suction for a time estimated to be sufficient to remove this estimated defective length.

The automatic piecing sensor 50 and the sliver sensor 51 shown schematically in the accompanying FIG. 1 drawing are of conventional design and operation and require no detailed descriptions.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A method of piecing yarn in the operation of an open end rotor spinning machine after an interruption in spinning wherein suction is applied to the package on which yarn has been wound to locate the yarn end thereon and to withdraw a sufficient length of yarn for severing a portion of the yarn end, the severed end is prepared for piecing, and the prepared end is fed into the rotor to pick-up fibers and restart spinning, the method comprising applying the suction during a normal piecing operation for a predetermined length of time sufficient to locate the yarn end on the package and provide the yarn end for satisfactory piecing while limiting said predetermined time to an optimal minimum for efficient operation, detecting for an indication of an abnormal spinning interruption condition that may have resulted in an extended length of defective yarn having been wound on said package, and in response to said detecting of an indication of an abnormal spinning interruption condition applying suction to the package for a predetermined length of time longer than said optimal minimum length of time sufficient to remove an estimated extended length of defective yarn.

2. A method of piecing yarn in the operation of an open end rotor spinning machine according to claim 1 and characterized further in that said detecting detects an indication of sufficient sliver being fed to the rotor to produce a satisfactory yarn.

3. A method of piecing yarn in the operation of an open end rotor spinning machine according to claim 1 and characterized further in that said detecting detects the absence of sliver for feeding to the rotor.

4. A method of piecing yarn in the operation of an open end rotor spinning machine according to claim 1 and characterized further in that said detecting detects a sequence of unsuccessful piecing operation attempts and said applying suction for a longer time is incorporated in a subsequent final piecing operation attempt.

5. A method of piecing yarn in the operation of an open end rotor spinning machine according to claim 1 and characterized further in that said detecting detects two sequential unsuccessful piecing operation attempts and said applying suction for a longer time is incorporated in a third final piecing operation attempt.

* * * * *